US005884443A

United States Patent [19]

Schimmelpfennig et al.

[11] Patent Number: 5,884,443

[45] Date of Patent: Mar. 23, 1999

[54] CONCRETE REINFORCING BAR PROTECTIVE COVER

[75] Inventors: Jerry D. Schimmelpfennig, Mt. Pleasant; Marcus William Powell, New London, both of Iowa; Richard Sylvan, Glenview, Ill.; Douglas James Spenner, Mt. Pleasant, Iowa

[73] Assignee: Lomont Molding, Inc., Mt. Pleasant, Iowa

[21] Appl. No.: 988,738

[22] Filed: Dec. 11, 1997

[51] Int. Cl.[6] ..... E04C 5/16

[52] U.S. Cl. ..... 52/301; 52/689; 74/558; 248/523

[58] Field of Search ..... 52/300, 301, 289, 52/689; 248/523, 188.9; 74/553, 558; 16/121

[56] References Cited

U.S. PATENT DOCUMENTS

D. 363,657 10/1995 Kassardjian et al. .
4,269,010 5/1981 Glass ..... 52/154
5,381,636 1/1995 Kassardjian et al. .
5,523,043 6/1996 Kassardjian et al. .
5,568,708 10/1996 Kassardjian et al. .
5,729,941 3/1998 Kassardjian ..... 52/301

*Primary Examiner*—Carl D. Friedman
*Assistant Examiner*—Beth A Aubrey
*Attorney, Agent, or Firm*—Zarley, McKee, Thomte, Voorhees & Sease

[57] ABSTRACT

A protective cover for the ends of reinforcing bars has a cylindrical tube having upper and lower ends. A cap is mounted on the upper end of the tube and is comprised of a continuous circular wall extending upwardly and outwardly from the upper end of the tube, with a bottom covering the top of the tube. A post extends upwardly from the center of the bottom, and a plurality of spaced rib elements are secured to and extend radially outwardly from the post for connection to the wall. A canopy is secured to the upper edge of the wall and extends slightly downwardly therefrom. The canopy has a circular perimeter which has a downwardly extending circular flange extending therearound. The ribs are tied together by secondary ribs. Friction bars are located within the tube to create friction between the tub and a bar upon which it is mounted.

7 Claims, 3 Drawing Sheets

CONCRETE REINFORCING BAR PROTECTIVE COVER

BACKGROUND OF THE INVENTION

During construction of buildings, bridges and the like, it is common to have the ends of steel reinforcing bars protruding from walls, columns and the like during various stages of the construction. The protruding ends of the reinforcing bars present a hazard to workmen who might fall on the bars.

Certain safety regulations in most locations now require that caps or covers be placed on the ends of the protruding bars so as to protect workers that might fall onto the bars. Occupational Safety and Health Standards Boards (OSHA) have established certain standards for such caps to insure that they are of sufficient strength and durability that the cap will maintain its integrity even under all reasonable conditions that a person might fall on the protruding bars. A typical standard would require that the caps be able to withstand the impact of a 250 pound weight dropped from a height of 10 feet without the protruding rod penetrating the cap. Minimum sizes of the cap are also established so that the top of the cap is substantially greater than the diameter of the bar on which it is mounted.

A typical existing cap for these purposes is illustrated in U.S. Pat. No. 5,568,708.

Some existing caps have a steel plate incorporated within a molded plastic cap to add strength thereto and to further resist puncturing of the cap when a load is imposed on the top of a rod. Such caps are relatively heavy for handling in bulk quantities, and the shipping costs thereof are obviously expensive. The incorporation of a metal plate in the plastic molding adds to the expense of manufacture through both cost of material and assembly expense.

It is, therefore, a principal object of this invention to provide a reinforcing bar cover that will withstand existing drop tests without having a steel plate inserted therein.

A further object of this invention is to provide a protective cover for reinforcing bars that is relatively light in weight, and efficiently and economically capable of being manufactured.

These and other objects will be apparent to those skilled in the art.

SUMMARY OF THE INVENTION

The protective cover for the ends of reinforcing bars of this invention has a cylindrical tube having upper and lower ends. A cap is mounted on the upper end of the tube and is comprised of a continuous circular wall extending upwardly and outwardly from the upper end of the tube, with a bottom covering the top of the tube. A post extends upwardly from the center of the bottom, and a plurality of spaced rib elements are secured to and extend radially outwardly from the post for connection to the wall.

A canopy is secured to the upper edge of the wall and extends slightly downwardly therefrom. The canopy has a circular perimeter which has a downwardly extending circular flange extending therearound. The ribs are tied together by secondary ribs. Friction bars are located within the tube to create friction between the tub and a bar upon which it is mounted.

DESCRIPTION OF THE PREFERRED EMBODIMENT

Figure 1:
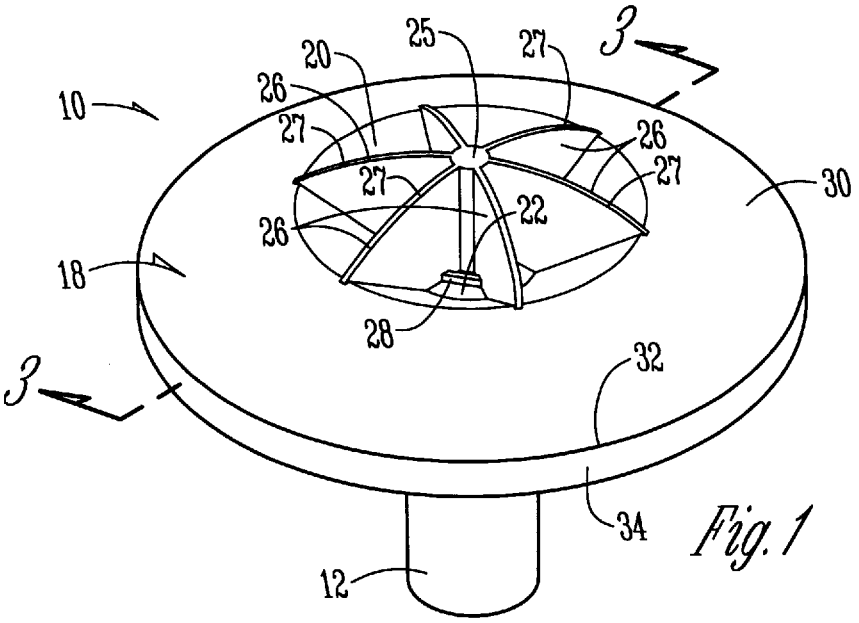
FIG. 1 is a top perspective view of the device of this invention.
Figure 2:
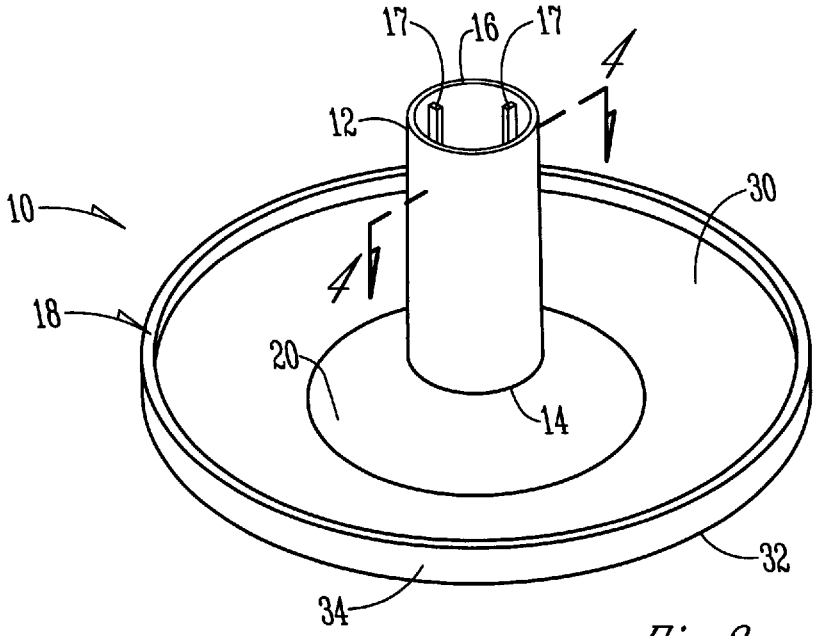
FIG. 2 is a bottom perspective view thereof.
Figure 4:
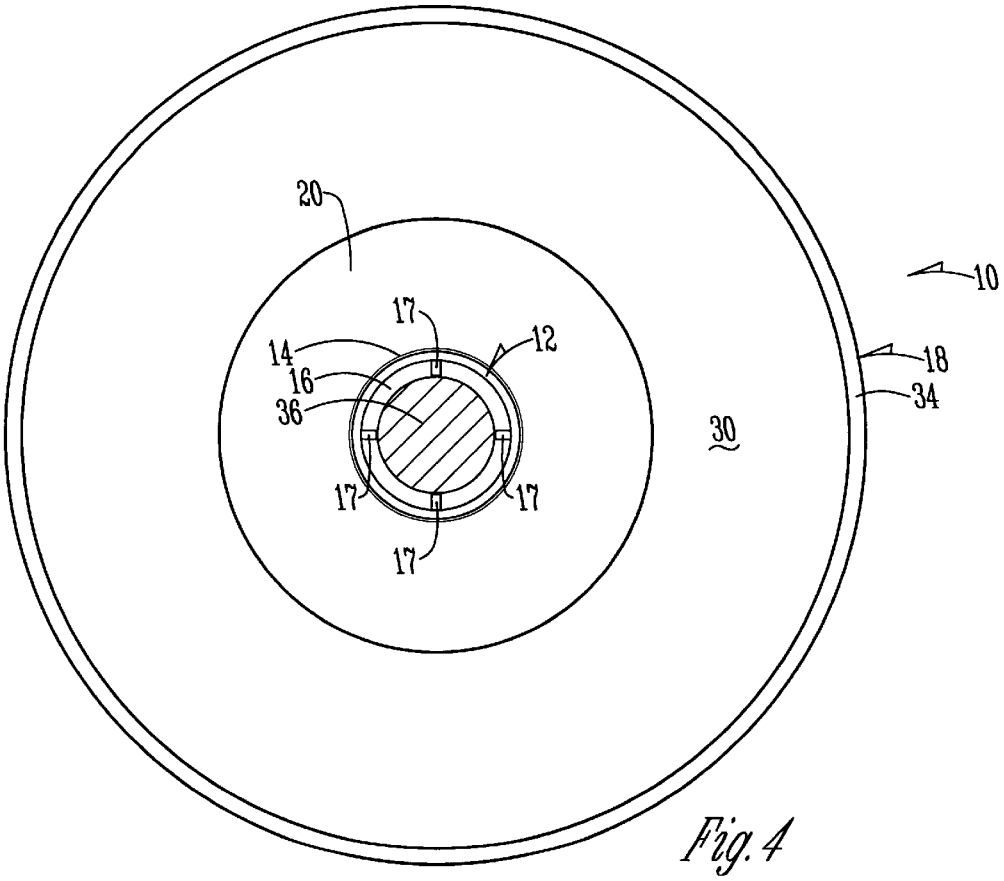
FIG. 4 is a bottom plan view thereof.

The cover 10 is comprised of a vertical hollow tube 12 which has an upper end 14 and an open lower end 16. A plurality of spaced vertically disposed friction bars 17 are formed on the inner surface of tube 12 to frictionally engage the end of a reinforcing bar which is inserted within the tube.

A cap 18 is positioned on the upper end 14 of tube 12. A conically shaped wall 20 extends upwardly and outwardly from the upper end 14 of the tube. Wall 20 has a circular upper edge 21. A bottom 22 closes the upper end 14 of tube 12, and a center post 24 extends upwardly from the center of bottom 22. The upper end 25 of post 24 extends above the level of the upper edge 21 of wall 20.

A plurality of flat ribs 26 with an arcuate upper edge 27 extend between the post 24 and the wall 20. The arcuate upper edge 27 of the ribs extends from the upper end 25 of post 24 downwardly to the upper edge 21 of wall 20. Secondary ribs 28 extend between adjacent ribs 26 adjacent the bottom of post 24 to further stiffen the ribs 28.

Figure 3:
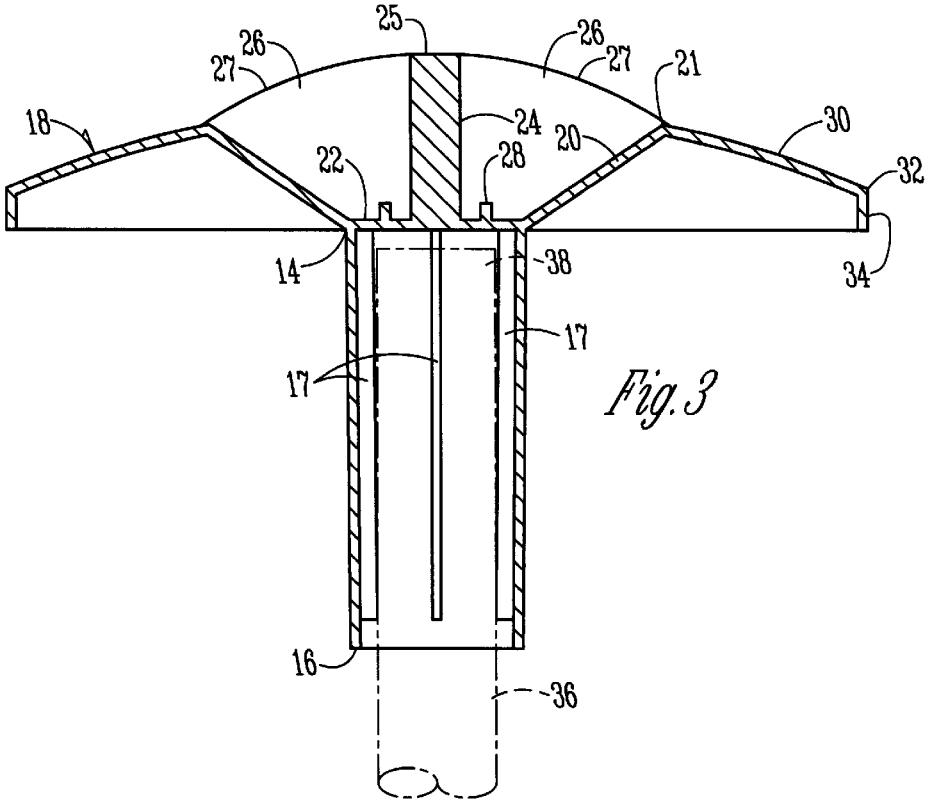
FIG. 3 is an enlarged scale sectional view taken on line 3—3 of FIG. 1.
Figure 5:
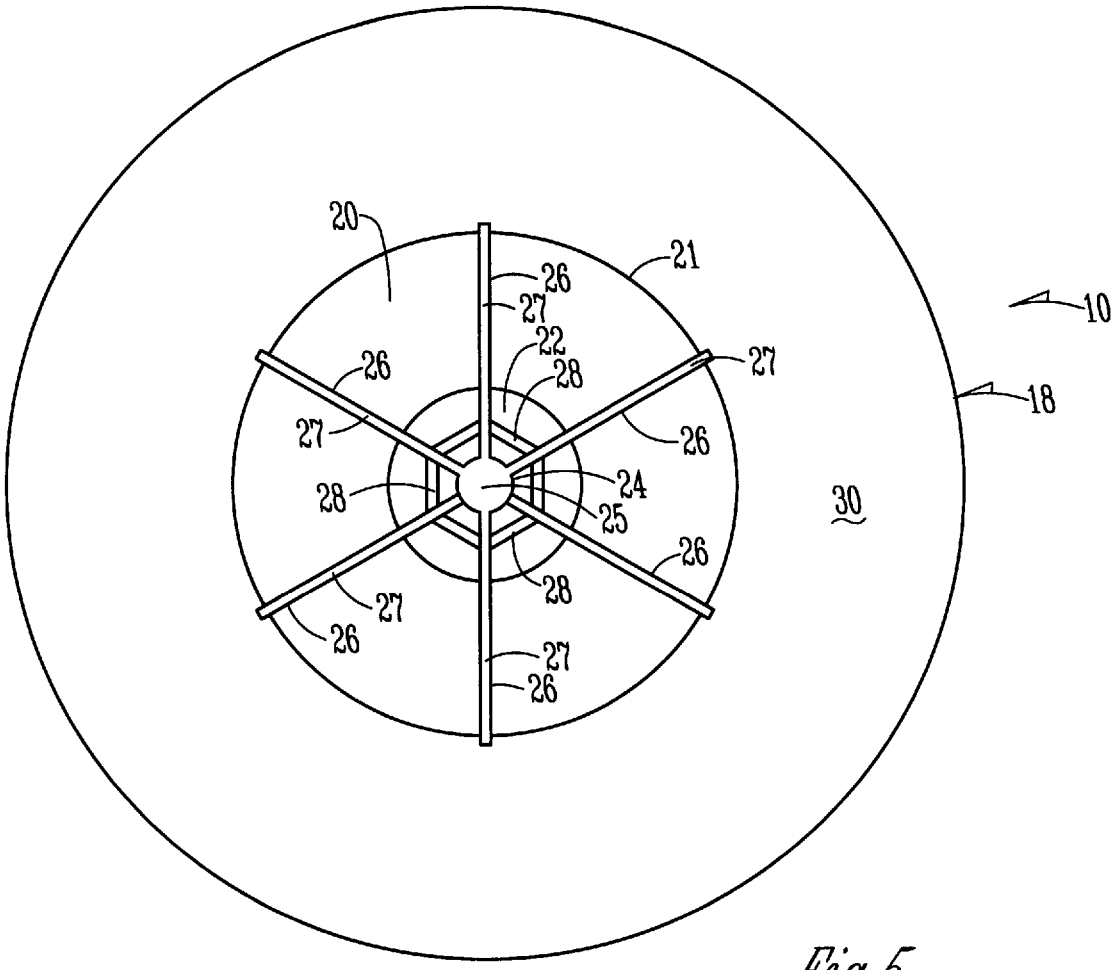
FIG. 5 is a top plan view thereof.

A canopy 30 extends from the upper edge 21 of wall 20 and extends in a curved direction downwardly and outwardly away from the upper edge 21 of the wall 20. The canopy 30 has a circular perimeter edge 32. A circular flange 34 extends uniformly downwardly from the perimeter edge 30. As shown in FIG. 3, an upper end of a reinforcing bar 36 is forcibly inserted within the interior of tube 12. The cover 10 thereupon protects a falling worker from being injured or impaled on the upper end 38 of the bar 36.

The cover 10 is preferably comprised of a dense nylon material. The ribs 26 absorb the shock of a person falling thereon. The radial position of the ribs prevents them from collapsing. The canopy provides a surface area of at least 16 square inches, including the area occupied by the ribs 26 to provide an adequate area to normally prevent substantial injury to a workman falling on the cover.

Six ribs 26 are preferred and are spaced at 60° apart from each other. The ribs and the center post 24 gives an effective thickness of the cover 10 at point of impact of approximately ¾ inches. The secondary ribs 28 prevent the ribs 26 from spreading in an impact situation.

The ribs 26 further strengthen the cover 10 under impact and prevent the reinforcing bar from being able to tear through the cover if it should be positioned slightly off center with respect to the bar. The overall conical shape of the wall 20 helps to guide any falling object away from the rod 36 inside the tube 12.

It is therefore seen that this invention will accomplish at least all of its stated objectives.

What is claimed is:

1. A protective cover for covering the end of a concrete reinforcing bar, comprising, a cylindrical tube having an open lower end and an upper end, a cap on the upper end of said tube, said cap including a continuous circular wall extending
upwardly and outwardly from the upper end of said tube
and having a bottom covering the upper end of said tube, a post extending upwardly from said bottom, a plurality of spaced rib elements secured to and extending
radially outwardly from said post for connection to said wall.

2. The protective cover of claim 1 wherein said wall has an upper edge, and a canopy is secured to said upper edge and extends around said circular wall.

3. The protective cover of claim 2 wherein said canopy has a circular perimeter with a downwardly extending circular flange extending therearound.

4. The protective cover of claim 1 wherein said ribs are tied together by secondary ribs extending between said ribs.

5. The protective cover of claim 2 wherein said canopy slopes downwardly and outwardly from the upper edge of said wall.

6. The protective cover of claim 1 wherein said protective cover is comprised of a plastic material.

7. The protective cover of claim 1 wherein vertical friction bars are secured within said tube.

* * * * *